United States Patent [19]

Moessinger

[11] 4,392,515

[45] Jul. 12, 1983

[54] WEAVING LOOM WITH A WAVING SHED HAVING AN IMPROVED FRAME

[76] Inventor: Albert Moessinger, Vaud, Switzerland

[21] Appl. No.: 236,237

[22] Filed: Feb. 20, 1981

[30] Foreign Application Priority Data

Feb. 21, 1980 [FR] France ..... 80 04125

[51] Int. Cl.[3] ..... D03C 13/00; D03D 47/26

[52] U.S. Cl. ..... 139/55.1; 139/57; 139/82; 139/436

[58] Field of Search ..... 139/55.1, 57, 58, 82, 139/91, 79, 443, 436, 188 R, 450

[56] References Cited

U.S. PATENT DOCUMENTS

| | | | |
|---|---|---|---|
| 1,734,513 | 11/1929 | Baldwin | 139/55.1 |
| 2,510,404 | 6/1950 | Lake et al. | 139/82 |
| 2,592,820 | 4/1952 | Moessinger | 139/57 X |
| 3,705,606 | 12/1972 | Stucki | 139/188 R |
| 3,766,950 | 10/1973 | Vasek et al. | 139/188 R |
| 4,022,252 | 5/1977 | Ogura | 139/82 X |
| 4,192,357 | 3/1980 | Tanaka et al. | 139/450 |

*Primary Examiner*—James Kee Chi

[57] ABSTRACT

The invention relates to a weaving loom with waving shed heddle frames which when built in accordance with the invention insures that the heddles do not have lateral displacement when the frames are operated by controls respectively acting on both sides of the frames so that the motions of the respective sides differ from each other in their pattern. The bars of the frames are pivotably connected to the supports of these frames. These supports slide in stationary guides which restrict the lateral motion of the frames.

13 Claims, 7 Drawing Figures

12
29
28
27
26
26'
29'
28'
27'
3°
25
24
23
22
21
20
50
25'
23'
22'
12
30
31
32
29
40

12
30
31
31'
30'
29
41
140
40
140'
41'

12
30
31
31'
30'
29
40

WEAVING LOOM WITH A WAVING SHED HAVING AN IMPROVED FRAME

BACKGROUND OF THE INVENTION

The present invention relates to the textile industry and in particular to an improved machine for controling heddle frames and permitting introduction of weft threads into the shed from one side of a loom.

The invention shall especially be described for the case where a weft thread is to be inserted in the shape of a loop. The invention, however, is not limited to this weft thread insertion technique and could be utilized with other types of looms such as looms which use a shuttle.

The insertion of a weft thread in the shape of a loop is an old technique which was abandoned, especially in fast looms, because abnormal tensions were produced as a result of the friction of the thread against the insertion device pin. However, means such as a controlled rotation of the insertion device pin were designed to avoid such friction. Another type of means to avoid such friction is described in French Pat. No. 1,562,147; according to this document, the thread is cast in the shape of a loop with one locked strand, while the other strand is cast. The kinetic energy of the cast strand which is transferred to the locked strand through the loop, changes into a force which moves with the loop and pulls the thread.

As indicated in the article published in the periodical "L'Industrie Textile," Issue No. 1083, November 1978, pp. 698–699, with an inertia insertion system where the locked strand is resting at the entrance to the shed before the loop reaches the exit point it is theoretically possible to start closing the shed and firmly pushing the thread at the entrance, before the pick of weft thread is completely unwound. This closing of the shed at the insertion side of the loom before the weft thread reaches the exit point may be performed by using rigid frames to control the heddles. Each end of these frames should move in a different pattern, such that the shed has a correct opening along the whole section where the free strand of the loop is moving, during the loom cycle, and closes up along the section of the pick of weft thread formed by the locked strand. The tightening of the pick of weft thread may be performed by means of a reed where each end of this reed moves in a different pattern, or else by means of a rotating reed which offers the advantage of being less noisy than a regular reed.

This solution which consists in providing for a different pattern of motion of each end of the heddle-holder frames controlling the warp threads, presents a disadvantage in that the heddles in conventional heddle frames wear out very rapidly in the heddle-holder rods, due to the lateral motion of the heddle-holders as a result of the variable inclination of the frames.

It has also been suggested in the German Pat. No. 1,091,949 to have each frame move in a differing pattern in weaving looms fed by a griff throwing system in the shape of a strip, the length of which is equivalent to the width of the material, in order to minimize the disadvantage of an opening larger than the shed resulting from such an insertion procedure. To that effect, the loom is equipped with a rigid stationary frame in which the heddle-holder rods, together with the heddles, each move in a different pattern. The motion is transmitted to the heddler-holder rods by plates guided in the stationary frame and driven by a rigid beam which is controlled at each end by two eccentrics each one moving in a differing pattern.

In such a design the shed moves so that the crossing of the warp threads moves along the shed as in the case of waving-shed looms. However, it presents some disadvantages, and especially the disadvantage of requiring more space in height than the classical frames, as well as of necessitating a considerable number of connections which wear out rapidly.

SUMMARY OF THE INVENTION

The present invention aims at correcting the disadvantages noted above and, in a general manner, relates to an improvement of the design of the heddle-holder frames.

Hereinafter in the description, the loom built in accordance with the invention shall be designated as a "single-phase weaving loom with waving shed." Such weaving looms have a series of waving sheds in which a series of small throwing systems, each containing a length of pick of weft thread, operate one after the other, traveling along the point after the last row of finished cloth. Due to the fact that, in looms operated in accordance with the invention, the thread is deposited into the shed while the loop unwinds, and that the changing of shed can be started before the loop reaches the exit point, the thread can be tightened in the first section of the shed while the pick of weft thread moves along in the rest of this shed.

In a general manner, the invention therefore relates to a single-phase weaving loom with a waving shed, in which the weft thread is pulled out of a stationary spool located outside of the shed. This loom is equipped with the following elements:

means to introduce the weft thread into the shed in the shape of a loop with one locked strand and one mobile strand, frames defined by rigid frame members for controlling travel of the heddles operated by controls respectively acting on both sides of said frames, each one moving in a differing pattern, a reed equipped and controlled so that its teeth progressively and firmly push the inserted pick of weft thread from where it enters the shed towards where it emerges, this loom being characterized by the fact that each frame is defined by frame bars which are movably attached to frame supports, and that these supports are guided or slide in stationary guides restricting the lateral motion of the frames.

In operation, the weft thread is inserted in the shape of a loop under its own kinetic energy, one of the strands being locked outside of the shed, whereas the other one is cast in the direction of the axis of said shed.

The motion of each of the frames is continuous, without any stop when the shed is open, this motion being a quarter of a cycle off on the side where the weft thread emerges from the shed, compared to the motion of the frames on the side where the weft thread enters into the shed. (FIG. 6)

When the pick of weft thread is introduced into the shed under its own mass, it is best that the loop enters into the shed between one-sixth and one-quarter of the way through the pick cycle, after the closing of the shed.

The frames may be controlled either by a cam system, or by means of classical dobbies.

The frame bars may be attached to the frame supports by means of silent blocks or elastic elements.

Finally, because of an improvement in the startup procedure, the loom built in accordance with the invention is also equipped with a device that facilitates the positioning of the first pick of weft thread when starting the loom.

BRIEF DESCRIPTION OF THE DRAWINGS

The invention and the advantages deriving therefrom shall however be more clearly understood from the description and from the examples illustrated with reference to the attached drawings, which are given hereinafter by way of example, but without the invention being limited thereto.

DETAILED DESCRIPTION

Figure 1:
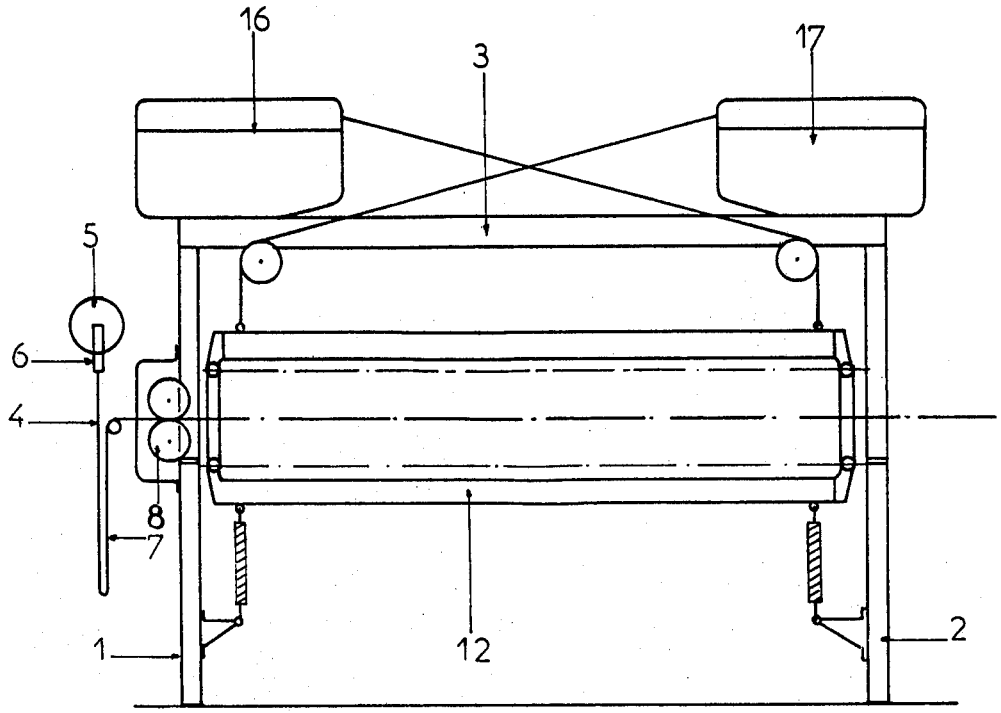
FIGS. 1 & 2 are respectively a front view and a side view of a weaving loom designed according to the invention.
Figure 2:
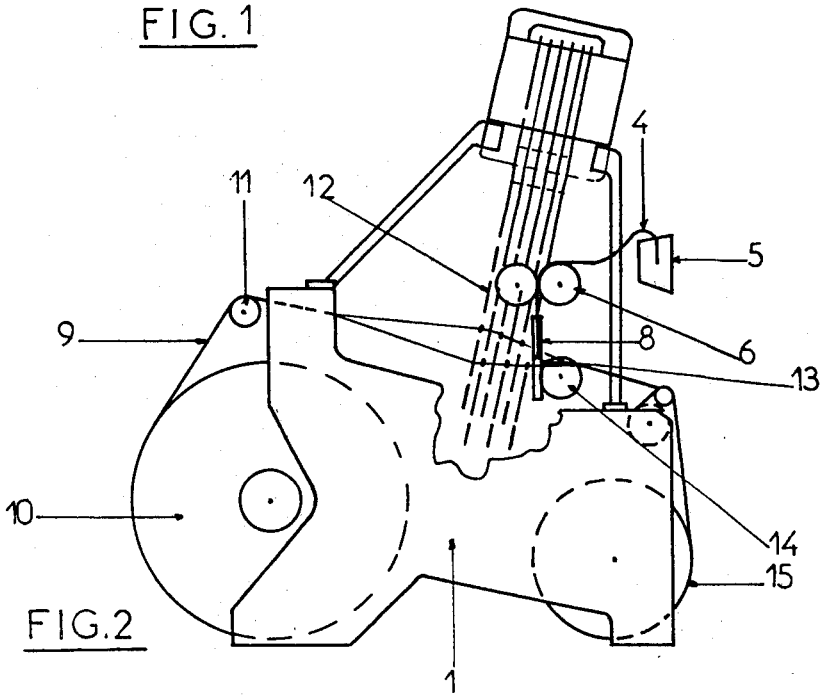

FIGS. 1 and 2 show the overall layout of a loom designed in accordance with the invention. In a general manner, this loom basically consists of a framework with two lateral supports 1, 2 maintained together by a spacer 3, all the operating elements of the loom being mounted on said framework. The weft thread 4 is drawn from a storage space 5 (spool) by a measuring device 6 which delivers the thread to a collecting unit 7. The weft thread 4 is cast in the shape of a loop by a casting system 8 for instance as described in French Pat. No. 1,562,647.

The warp threads are drawn from a warp beam 10, over a tension roller 11 threaded through the heddles in the heddle frames 12 which separate them, thus forming the shed 13 into which the weft thread 4 is cast.

In operation of the invention, the shed is formed by operating the heddle frames 12 so that the ends of these heddle frames move, in a different pattern, as the loop of weft thread unwinds.

A rotating reed 14 tightens the inserted pick of weft thread by progressively and firmly pushing the pick of weft thread as it is positioned. The weaving elements are synchronously driving by a motor. The casting system 8 is operated by a separate control. The finished cloth is delivered in a conventional manner at the speed required to obtain the desired tightening, and it is then rolled onto a cloth beam 15.

Figures 3, 4, 5:
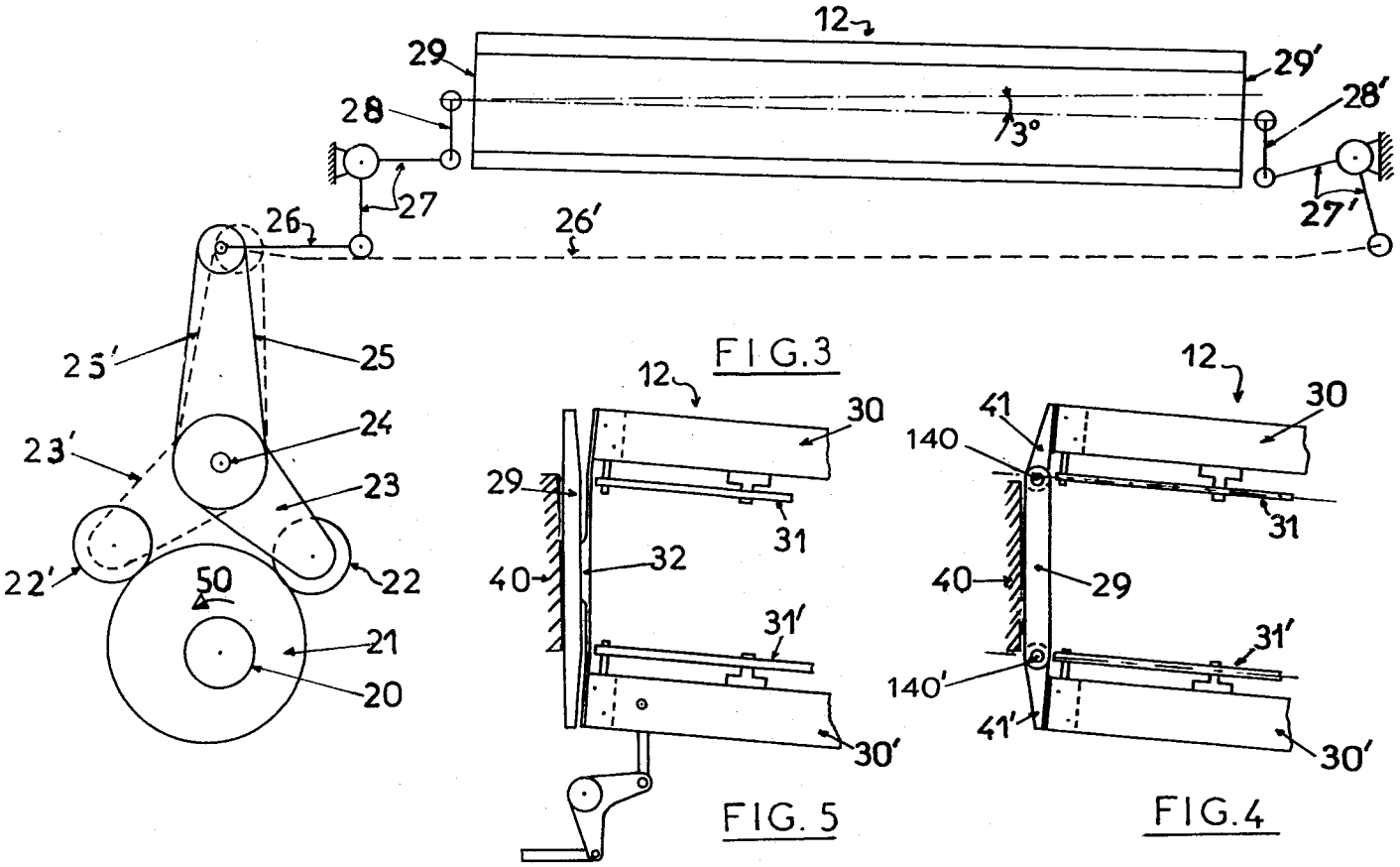
FIG. 3 shows an arrangement of a control system by means of cams and heddle-holder frames.
FIG. 4 shows a silent-block connection to link the supports of the heddle-holder frame to the bars.
FIG. 5 shows an elastic-element connection which may be used instead of the connection shown in FIG. 4.

The heddle frames may be controlled either by means of dobbies 16, 17, as shown in FIG. 1, or by means of a cam system shown in FIG. 3. Of course, the utilization of any other equivalent control system will still be within the scope of the invention.

FIG. 3 is a more detailed view of the cam control system used to control both sides of the heddle-holder frames such that the shed progressively opens and closes as the pick of weft thread is positioned.

This system operates as follows:

Some eccentrics 21 which are keyed to shaft 20 act upon rollers 22, 22' of the levers 23, 23' rotating about a stationary shaft 24. Shaft 20 rotates at half the speed of the loom. The rods 26, 26' acting on the frame 12 through the bent levers 27, 27' and the small rods 28, 28' are connected to an extension 25, 25' of the levers 23, 23'. The shaft 20 rotating in the direction of the arrow 50 and the two rollers 22, 22' being controlled by the same eccentric 21, cause motion of the support 29' to the right of the frame 12 to be the same as the motion of the support 29 to the left of the frame, but with a 90° displacement measured on the shaft of the eccentric 21, that is to say 180° of the loom cycle. If this is the case, the pick of weft thread shall be inserted from the left to the right.

When the heddle frames 12 are controlled by means of dobbies 16, 17, as shown in FIG. 1, the system is similar to that previously described, consisting in keying and unkeying the cam (eccentric 21) on the shaft 20 according to the desired motion. Classical dobbies may be utilized by installing a dobby on each side of the loom as shown in FIG. 1.

As mentioned before, the variable inclination of the frames 12 ranging around ±2°, however small it may be, gives to the motion of the heddler-holder rods (not shown) a horizontal component tending to produce a slipping of the heddles and to wear them out.

FIGS. 4 and 5 show examples of heddle-holder frames designed in accordance with the invention, which permit elimination of this disadvantage.

In a general manner, these types of designs consist in pivotably connecting the supports (29) (29') of the heddle frame 12 to the bars 30, 30' with which this frame is equipped.

In the example of the design shown in FIG. 4, the upper and lower bars 30, 30' of the heddle frame 12 are pivotably connected to the supports 29, 29' by means of a silent-block system 140, 140' at a point aligned with the axis of the heddle-holder rods 31, 31'. To that effect, each support 29 or 29' consists of a rigid part 29, 29' sliding in a stationary guide 40. The parts 41, 41' rigidly locked with bars 30, 30' are pivotably connected to the ends of this part 29, 29'. Since the connections (silent-block 140, 140') are aligned with the extension of the axes of the heddle-holders 31, 31', and the supports 29 where these connections are attached are guided on the sides by the stationary guides 40, the motion of the heddles shall nearly be parallel to the direction of the guides 40. When the bars 30, 30' and heddle holder, 31, 31' are displaced at an angle of about 3° from the horizontal, a lateral displacement of about 0.5 mm at the level of the heddle-holders 31, 31' results in the case of a frame designated in accordance with the invention, whereas there would be a 10 mm displacement in the case of a classical rigid frame; in addition, the lateral motion of the threads with respect to their normal position of the loom is avoided.

Consequently, when the frame is guided on its sides by lateral supports, the lateral horizontal component of the motion of the heddle-holder rod 31 becomes negative.

In the example shown in FIG. 5, the connection is replaced by an elastic element 32, the center of said element being attached to the support 29 whereas each of its ends are attached to the bars 30, 30' of the frame 12. The shape of the elastic element 32 shall be chosen so that the lateral motion of the heddle-holder rod 31 will be as small as possible.

Figure 6:
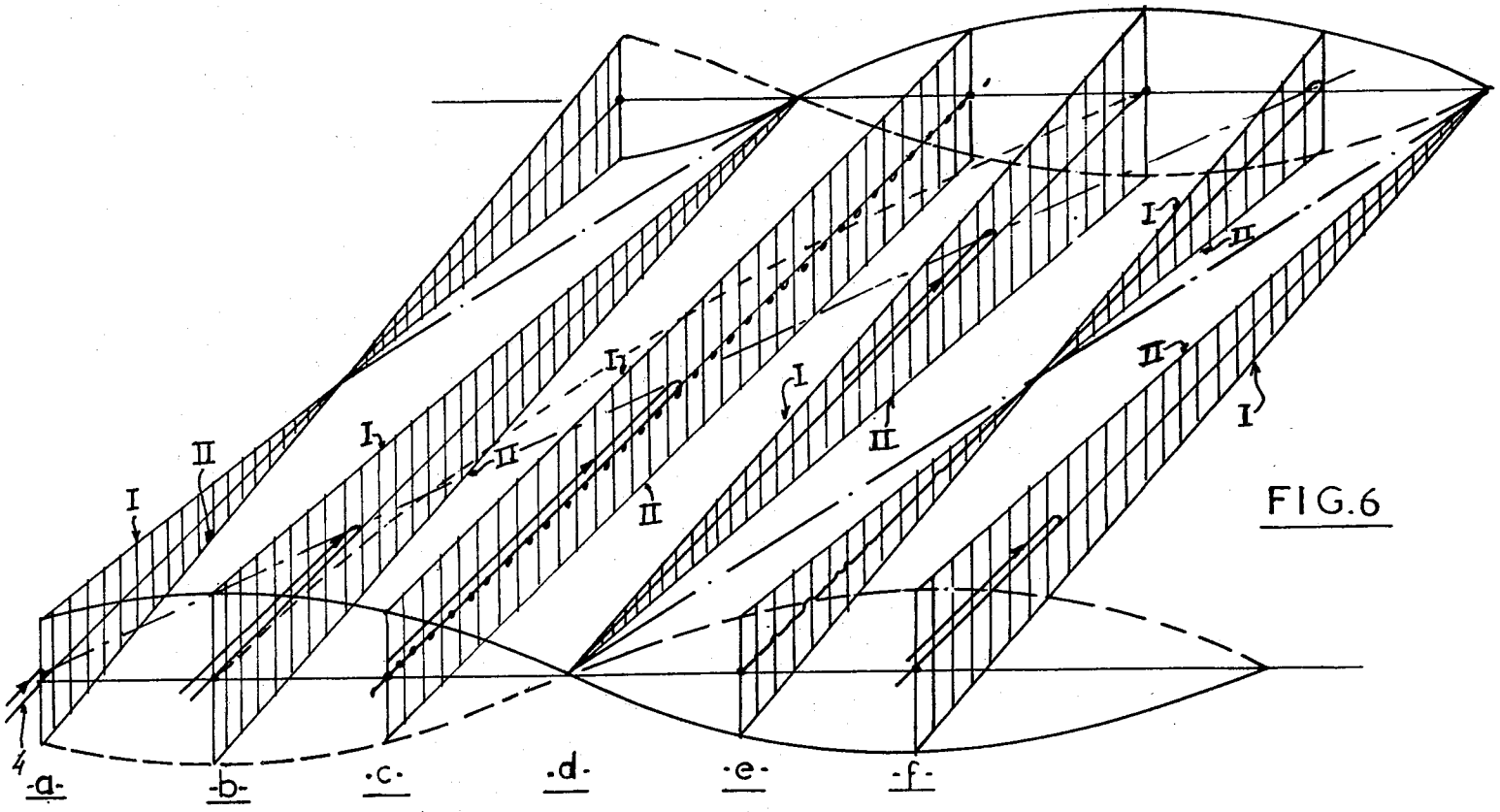
FIG. 6 is an axonometric view of the various phases (referenced from "a" to "f") of the development of the opening of the shed in a loom designed as per the invention.

The diagram shown in FIG. 6 gives a more detailed illustration of the operation of a loom built in accordance with the invention.

FIG. 6 shows the various phases (referenced "a" to "f"), illustrating the motion of the frames during an insertion (or pick) cycle. Between each phase, "a" to "f", the loom operates one-fourth of a rotation. In "a", the frames I & II intersect in the center of the shed and the loop of weft thread 4 enters into the new shed. In "b", the entrance to the shed is fully open and its exit is closed; the pick of weft thread has traveled about one-fourth of the maximum width of material which can be woven. In "c", the entrance to the shed has become smaller whereas its exit has increased; the pick of weft thread arrives in the center of the shed.

In "e", the motion of the frames is reversed with respect to the position "a", the pick of weft thread previously introduced is firmly pushed by the reed against the finished cloth, and a new shed is opening to receive a new pick of weft thread. The first pick of weft thread 4 continues moving and arrives at the exit of the shed. Position "f" is equivalent to position "b".

FIG. 6 also permits determination of the best time to cast the thread into the shed. If the thread crosses the shed at a constant speed, its entrance shall be best at one-quarter of the way into a pick cycle; but since the speed of the thread tends to slow down, the casting shall slightly be advanced to be best operated between one-sixth and one-quarter of the cycle, the origin of the cycle being the moment when the shed is flat on the side where the weft thread enters.

The advantages resulting from the invention shall however be more evident with the following computation. In the case of rigid frames with their ends moving in differing patterns, the relative lateral displacement of the heddle-holder rod is about 10 mm. With the device of the present invention, the displacement shall be negligible, amounting to about 0.5 mm, therefore smaller than the operating clearance required for regular frames. On the other hand, the maximum angle constituted by the frame with the horizontal is about 3°. To slide along such an incline, the friction coefficient should be lower than 0.05°; that is to say in these conditions the heddle with not tend to slide on the side. Therefore, we can say that the friction or sliding conditions of the heddles in the heddle-holder rods of the frames, as per the invention, are absolutely equivalent to those existing in the conventional frames.

Some variations of the loom build in accordance with the invention can be designed without going beyond the scope of the invention.

Thus, it is possible to start introducing the pick of weft thread well before the opening of the shed reaches its maximum so that, when the thread is close to where it emerges, the opening of the shed keeps increasing, thus taking into account the spread of the motion of the thread which may result when a thread is freely cast into the air.

Figure 7:
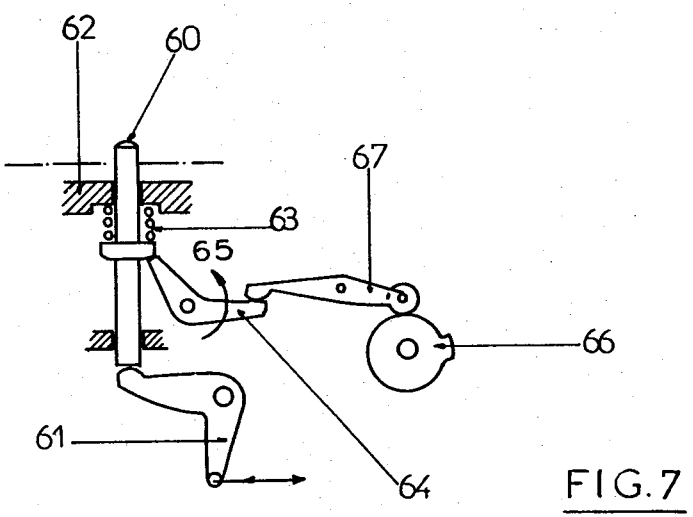
FIG. 7 is a diagram of a device permitting the casting of the thread by delayed-action release, when the loom is started, ready to operate the positioning of the first pick of weft thread.

In order to facilitate the startup of the loom, a delayed-action release system can be utilized for casting the thread for the first pick of weft thread, as shown in FIG. 7. In FIG. 6, the dot-and-dash line shows the trajectory of the loop moving at a constant speed in the shed of a loom also running at a constant speed. At the startup of the loom before the loom reaches full speed, it is best to cast the first pick of weft thread with a certain delay so that the loop may follow a trajectory along the dashed line shown in FIG. 6, and which results from the acceleration of the loom. Eventually, we could plan to cast the thread in an idle shed, that is to say during the phase "c", the dotted line, of FIG. 6.

The operation for delaying of the casting of the thread at the startup of the loom is shown in FIG. 7, performed by means of an auxiliary pin 60, usually outside of the course of the thread, which is moved into the trajectory of the thread before or during the starting operations, and which withdraws after the loom has reached the desired speed. The first casting shall be performed as usual. To that effect, as shown in FIG. 7, at the delay and the following startup, the lever 61 which is connected with the startup mechanism, pushes the pin 60 out of its guiding element 62 by compressing the spring 63. When the pin 60 is up, the catch 64 becomes engaged under the effect of a spring not shown on the drawing (arrow 65) and holds the pin 60. At the time of startup of the loom, the lever 61 is back to its down position, and as soon as the loom has reached the desired position, the cam 66 triggers the catch 64 through the lever 67, which causes the pin to withdraw into its guide 62 under the effect of the spring 63.

As mentioned before, the invention has been described in accordance with the Patent Statutes with great detail for one embodiment. The invention is not limited to the weaving looms in which the weft thread is inserted in the shape of a loop, but is may also be implemented in all the cases when the weft thread is inserted by unwinding a specific length of thread from one side of the loom, for instance by utilizing a small shuttle on which said weft thread is wound.

What is claimed is:

1. A weaving loom having a waving shed comprising:

propelling means for introducing and propelling a weft thread into the shed wherein the weft thread is inserted by unwinding a specific length of thread from one side of the loom;

a plurality of frame means wherein each frame means includes:

a width to extend throughout the width of a cloth to be woven, heddle holder rods, bars, and supports wherein the opposite ends of said bars are moveably connected to opposite ends of said supports at points aligned with the axes of said heddle holder rods;

stationary guides adapted to direct said supports in their reciprocating cycle to restrict lateral motion of each frame;

controls adapted to permit each end of each frame to proceed through its reciprocating cycle independantly of the opposite end; and a reed for pushing each pick of inserted weft thread.

2. The weaving loom of claim 1, wherein each frame means is adapted to be driven such that the motion at each end of said frame means is continuous and without stop when the shed is open.

3. The weaving loom of claim 1 wherein each frame means is adapted to be controlled such that the motion of the frame means on the side where the weft thread exits the shed will differ from the motion of the frame means on the side where the weft thread of the enters the shed by ¼ a cycle of operation.

4. The weaving loom of claim 3 wherein the propelling means is adapted to be controlled in relation to control of the frame means for the weft thread to enter the shed after the first one-sixth and before the first quarter of each cycle of insertion.

5. The weaving loom of claim 1, wherein the motion of each end of each frame means is controlled by one common cam cooperating with two levers equipped with rollers, each roller being adapted to move in the direction of the cam's rotation in a differing pattern to that of the other roller.

6. The weaving loom of claim 1, wherein the bars of each frame means are connected to the supports thereof by means of silent blocks.

7. The weaving loom of claim 1, wherein the bars of each frame means are connected to the supports thereof by means of elastic elements.

8. The weaving loom of claim 1 wherein the reed comprises a rotatable reed having teeth for firmly pushing each weft thread, said teeth being mounted for moving spirally during rotation of the reed so that the teeth which are at the exit of the shed will be 180° off with those which are at the entrance, the reed being adapted to perform at least one rotation per loom cycle.

9. The weaving loom of claim 8, wherein reed is adapted to perform a plurality of rotations per cycle and in which the displacement angle of the teeth is the product of 180° by the number of rotations of the reed per cycle of operation.

10. The weaving loom of claim 1 or claim 8, further comprising means adapted to delay the first cast of the weft thread at the start-up of the loom.

11. A weaving loom comprising:

a plurality of heddle frames, each frame being defined by two laterally spaced rigid crossbars, and by two supports which are pivotably connected between opposed ends of said crossbars to permit variation of the angle between said supports and said crossbars; and guide means slidably associated with at least one support of each heddle frame to minimize lateral displacement of heddles of each frame upon displacement of said frames during use.

12. A weaving loom according to claim 11, in which the guide means is provided on opposed sides of the loom to guide displacement of each support in a vertical direction along its elongated axis during motion of each frame during use.

13. A single-phase weaving loom having a waving shed, and a stationary spool located outside of the shed from which a specified length of weft thread may be pulled comprising in combination:

means to introduce the weft thread into the shed in the shape of a loop with one locked strand and one mobile strand;

a plurality of frames defined by rigid frame members having controls respectively acting on both sides of said frames adapted to permit travel in differing patterns of the heddles operated by each frame and each frame being defined by frame bars having heddle holder rods and frame supports which are movably attached to the frame bars at points aligned with the axes of the heddle holder rods in each frame means;

stationary guides adapted such that these supports may slide in stationary guides restricting the lateral motion of the frames;

a reed equipped and controlled so that its teeth progressively and firmly push the inserted length of weft thread from where it enters the shed towards where it emerges.

* * * * *